US008764368B2

(12) United States Patent
Crossley et al.

(10) Patent No.: US 8,764,368 B2
(45) Date of Patent: Jul. 1, 2014

(54) APPARATUS AND METHOD FOR HANDLING TUBULARS

(75) Inventors: Nathan Crossley, Penhold (CA); Sean Freeman, Red Deer (CA)

(73) Assignee: Accuform Welding Ltd., Alberta (CA)

( * ) Notice: Subject to any disclaimer, the term of this patent is extended or adjusted under 35 U.S.C. 154(b) by 309 days.

(21) Appl. No.: 12/870,474

(22) Filed: Aug. 27, 2010

(65) Prior Publication Data

US 2011/0070054 A1 Mar. 24, 2011

Related U.S. Application Data

(60) Provisional application No. 61/244,615, filed on Sep. 22, 2009.

(51) Int. Cl.

| | |
|---|---|
| ***E21B 19/00*** | (2006.01) |
| ***E21B 19/15*** | (2006.01) |
| ***E21B 19/20*** | (2006.01) |

(52) U.S. Cl.
USPC ..... 414/22.57

(58) Field of Classification Search
USPC ..... 14/69.5; 193/38; 414/22.51–22.59, 414/22.61–22.62, 779, 782, 777; 187/211; 244/63; 254/10 C, 10 R, 8 R, 9 R
See application file for complete search history.

(56) References Cited

U.S. PATENT DOCUMENTS

| | | | | |
|---|---|---|---|---|
| 3,053,401 | A * | 9/1962 | Jinkins, Jr. | 414/22.59 |
| 4,067,453 | A * | 1/1978 | Moller | 414/22.61 |
| 4,235,566 | A | 11/1980 | Beeman et al. | |
| 4,347,028 | A | 8/1982 | Dugan | |
| 4,379,676 | A | 4/1983 | Frias | |
| 4,382,738 | A | 5/1983 | Frias | |
| 4,386,883 | A | 6/1983 | Hogan et al. | |
| 4,403,898 | A | 9/1983 | Thompson | |
| 4,494,899 | A | 1/1985 | Hoang et al. | |
| 5,122,023 | A * | 6/1992 | Mochizuki | 414/22.61 |
| 6,079,925 | A | 6/2000 | Morgan et al. | |
| 6,533,519 | B1 | 3/2003 | Tolmon et al. | |
| 6,994,505 | B2 | 2/2006 | Hawkins, III | |
| 7,021,880 | B2 | 4/2006 | Morelli et al. | |
| 7,163,367 | B2 | 1/2007 | Handley | |
| 7,404,697 | B2 * | 7/2008 | Thompson | 414/22.58 |
| 2004/0136813 | A1 * | 7/2004 | Pietras | 414/22.51 |
| 2005/0079044 | A1 | 4/2005 | Handley | |
| 2005/0238463 | A1 * | 10/2005 | Smith | 414/22.52 |
| 2006/0104746 | A1 * | 5/2006 | Thompson | 414/22.54 |
| 2006/0124356 | A1 | 6/2006 | Gust et al. | |
| 2006/0285941 | A1 | 12/2006 | Fikowski et al. | |
| 2009/0053013 | A1 | 2/2009 | Maltby | |

FOREIGN PATENT DOCUMENTS

| | | |
|---|---|---|
| CA | 2 224 638 | 12/1997 |
| CA | 2 431 213 A1 | 6/2003 |
| CA | 2 431 229 | 6/2003 |
| CA | 2 444 446 | 10/2003 |
| CA | 2 476 109 | 7/2004 |
| CA | 2510137 | 6/2005 |

* cited by examiner

*Primary Examiner* — Gregory Adams
(74) *Attorney, Agent, or Firm* — Sheridan Ross P.C.

(57) ABSTRACT

An apparatus for use in delivering tubulars to an elevated work area is described. A slideway for receiving a tubular is mounted on the leading end of an extendable carriage. The opposing end of the carriage is pivotally fixed to a frame assembly. Extension of the carriage drives the leading end towards a work area. A carriage support ramp receives the leading end of the carriage as it is extended, and guides the leading end towards the elevated work area for discharge of the tubular from the slideway.

13 Claims, 6 Drawing Sheets

APPARATUS AND METHOD FOR HANDLING TUBULARS

FIELD OF THE INVENTION

An apparatus and method for use in raising and lowering tubulars to and from an elevated work area is described. More particularly, tubulars may be advanced or retracted along an extendable carriage that is fixed at one end to a base frame assembly.

BACKGROUND OF THE INVENTION

Various derrick operations require repetitive handling of heavy tubulars, for example lengths of drill pipe, drill collars, subs, and logging tools. Such tubulars must be carefully positioned over the mouse hole or hole centre in order to make up and convey strings of tubulars downhole. Repetitive manipulation of heavy tubulars in close proximity to various rig personnel poses a site safety hazard, and various operating protocols are typically implemented to minimize the risk of hazardous incidents.

Generally, tubulars are lifted and lowered to the work area by a pipe handling system associated with a catwalk assembly. In the case of drill pipe, a rack of pipe lengths is typically placed on either side of the catwalk, and the pipe handler receives individual lengths of pipe from each rack for advancement towards the derrick floor along a trough. Existing methods for raising the trough towards the work area generally involve extending a support leg beneath one or both ends of the trough, the support leg(s) pivotally attached to both the catwalk assembly and the trough to lift and advance the trough towards the derrick floor. A skate advances the drill pipe along the trough so it may be received by rig personnel and/or vertical handling equipment, for attachment to previous lengths of drill pipe already downhole.

Similarly, break-down of long tubing strings requires careful removal and reorientation of tubular sections from the derrick onto transportable pipe racks, with minimal handling by rig personnel.

Prior catwalk-based handlers typically lift lengths of pipe from below and/or have sliding components that travel along the base frame during lifting or lowering. With so many moving and advancing components, there is increased hazard to personnel using the catwalk, and increased likelihood of dropping the tubular.

U.S. Pat. No. 6,994,505 to Hawkins, describes a lift frame pivotally attached to a base, for use in lifting lengths of pipe to a rig floor. The front end of the lift frame is raised by a lift arm to at least rig height. A telescopic trough advances from the lift frame to deliver the pipe to the rig floor.

CA 2,224,638 describes a pipe handler in which a pivoting leg member raises the front end of a pipe trough towards a rig floor, and the trough also advances longitudinally along the base frame.

U.S. Pat. No. 4,235,566 to Beeman and Beeman describes a pipe-conveying catwalk assembly in which a pipe is carried on a trough extension that is nested in a boom arm. The extendable boom arm is driven up a ramp along a track towards the rig by a pair of swing arms pivotally attached to the frame.

SUMMARY OF THE INVENTION

It is an object of the present invention to obviate or mitigate at least one disadvantage of previous tubular handling systems.

In one aspect, there is provided an apparatus for use in delivering tubulars to a work area, the apparatus comprising:

- a base frame assembly for placement adjacent a raised work area;
- a support ramp extending from the base frame assembly towards the work area;
- an extendable carriage member comprising: a stationary end pivotally anchored to the frame in alignment with the support ramp and work area; and an opposing leading end advanceable against the support ramp upon extension of the carriage member;
- a slideway for carrying a tubular, the slideway operatively attached to the leading end of the carriage member; and
- means to extend the carriage member so as to advance the leading end against the carriage support ramp, thereby advancing the slideway towards the work area.

In an embodiment, the leading end of the carriage comprises a roller for guiding the leading edge against the support ramp. The support ramp may comprise a track for engaging the roller. The support ramp may comprise guide stops for preventing lateral movement of the carriage as it is advanced against the ramp.

In another embodiment, the means to extend the carriage member comprises a hydraulic cylinder attached to a first carriage segment and a second carriage segment, the hydraulic cylinder for driving the first carriage segment in extension from the second carriage segment.

In another embodiment, a locking mechanism is provided for locking the position of the first carriage segment with respect to the second carriage segment.

In another embodiment, the carriage is of sufficient length to position the slideway over the work area when the carriage is fully extended.

In another embodiment, the support ramp is adjustable in length by sliding extension of a first ramp segment against a second ramp segment. The apparatus may further comprise a hydraulic cylinder operatively attached to the first and second ramp segments, for driving the first ramp segment in sliding movement with respect to the second ramp segment.

In an embodiment, the base frame assembly further comprises a catwalk surface.

The apparatus may further comprise a storage rack for supplying and receiving tubulars to and from the slideway.

In an embodiment, the slideway further comprises a skate assembly for use in discharging tubulars from the slideway.

In another aspect, there is provided a method for delivering tubulars to a raised work area, the method comprising the steps of:

- providing a slideway for receiving and discharging tubulars, the slideway disposed on an extendable carriage, the extendable carriage pivotally fixed to a base frame assembly adjacent a raised work area;
- receiving a tubular upon the slideway;
- extending the carriage in length to direct a leading end of the carriage toward the work area;
- providing a support ramp for guiding the leading edge of the extendable carriage toward the work area as the carriage is extended;
- sliding the tubular along the slideway toward the work area; and
- discharging the tubular from the slideway.

In an embodiment, the method further comprises the step of bracing the support ramp against a support surface adjacent the work area.

In an embodiment, the method further comprises the step of adjusting the length of the support ramp to extend from the base frame assembly to the work area.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Generally, the present invention provides a method and apparatus for delivering tubulars towards a raised work area. An extendable carriage is generally supported by a frame assembly, which is secured adjacent the work area (for example the frame assembly may be fixed against a drilling rig). A carriage support ramp is secured to the frame proximal to, and extending towards, the work area for guiding a leading end of the carriage toward the work area as the carriage is extended.

The extendable carriage bears a slideway portion towards the leading end, for receiving and discharging tubulars. The slideway is advanced and withdrawn with respect to the work area by extension and retraction of the carriage. As the carriage is extended and retracted, the leading end of the carriage travels against the carriage support ramp, advancing the slideway towards the elevated work area. Once the slideway (and therefore the tubular) is suitably accessible from the work area, the tubular is discharged or otherwise removed from the slideway to the work area, for delivery downhole.

Any or all of the carriage support ramp, extendable carriage, and frame assembly may be adjustable and/or extendable to accommodate various work area heights, sizes, and configurations.

The added stability offered by the lift-free sliding extension and retraction of the carriage is expected to result in faster and more reliable cycle times, in addition to improving safety.

Overview

Figure 1:
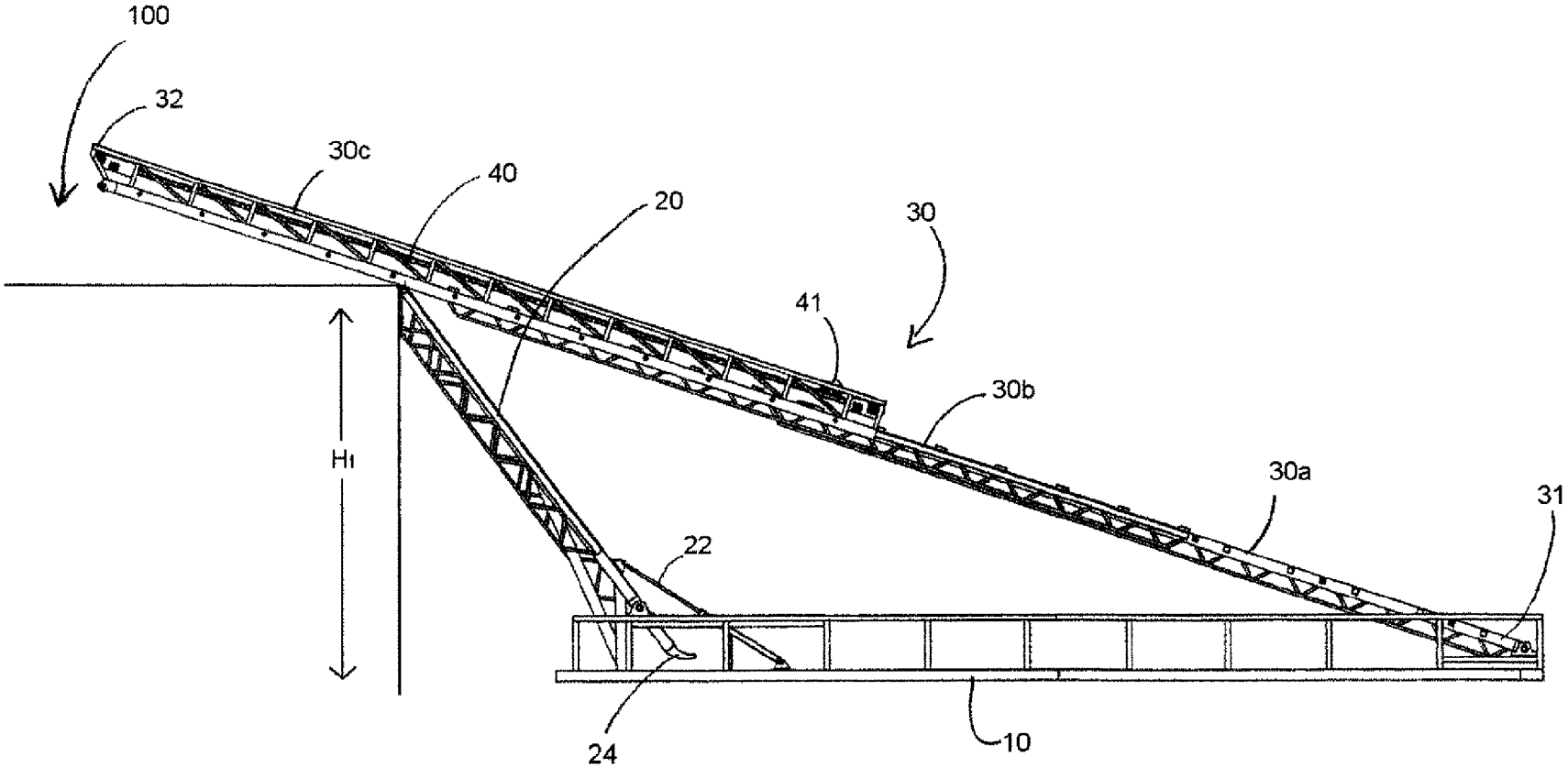
FIG. 1 is a side view of an apparatus for delivering tubulars to an elevated work area, in one embodiment, with carriage fully extended.

With reference to FIG. 1, a frame assembly 10 is positioned adjacent a raised work area 100. A carriage support ramp 20 is fixed to the frame, extending towards the work area 100 such that the carriage support ramp may guide travel of a leading end 32 of the extendable carriage 30 towards the work area. For example, when the work area is a drilling platform, the carriage support ramp 20 may be attached to the rig floor adjacent the work area by welding of bracket 29, or the carriage support ramp may be secured by any other suitable means.

Extendable carriage 30 (formed from three co-planar or otherwise parallel sliding carriage segments 30*a*, 30*b*, and 30*c*), is fixed to the frame assembly 10 at a first end 31. That is, the first, fixed end 31 of the extendable carriage is attached to the frame 10 at a location distal to the work area, while a second, leading end 32 of the extendable carriage, remains unattached to the frame.

Figure 2:
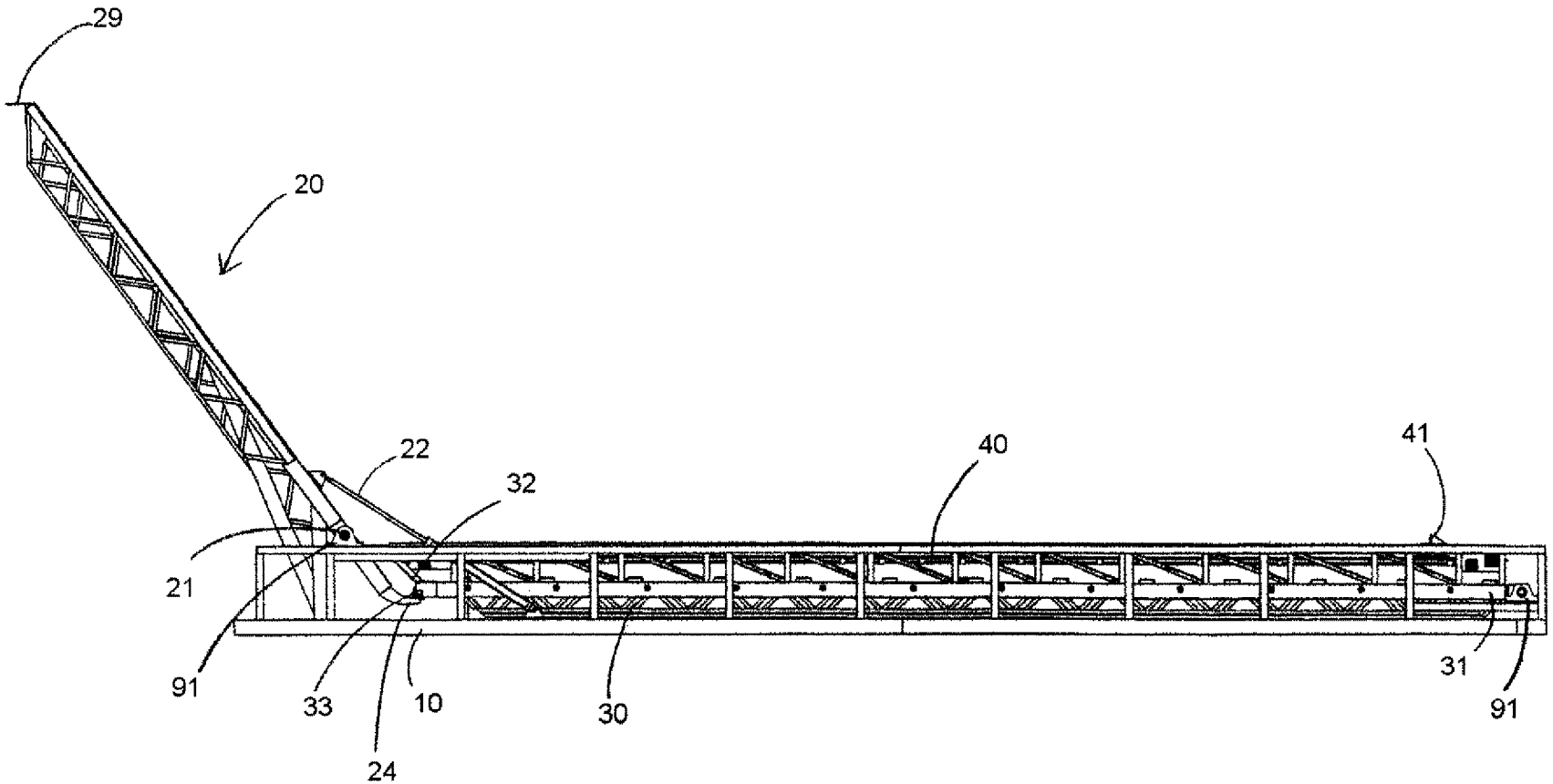
FIG. 2 is a side view of an apparatus for delivering tubulars to an elevated work area, in one embodiment, with carriage in retracted position.
Figure 3:
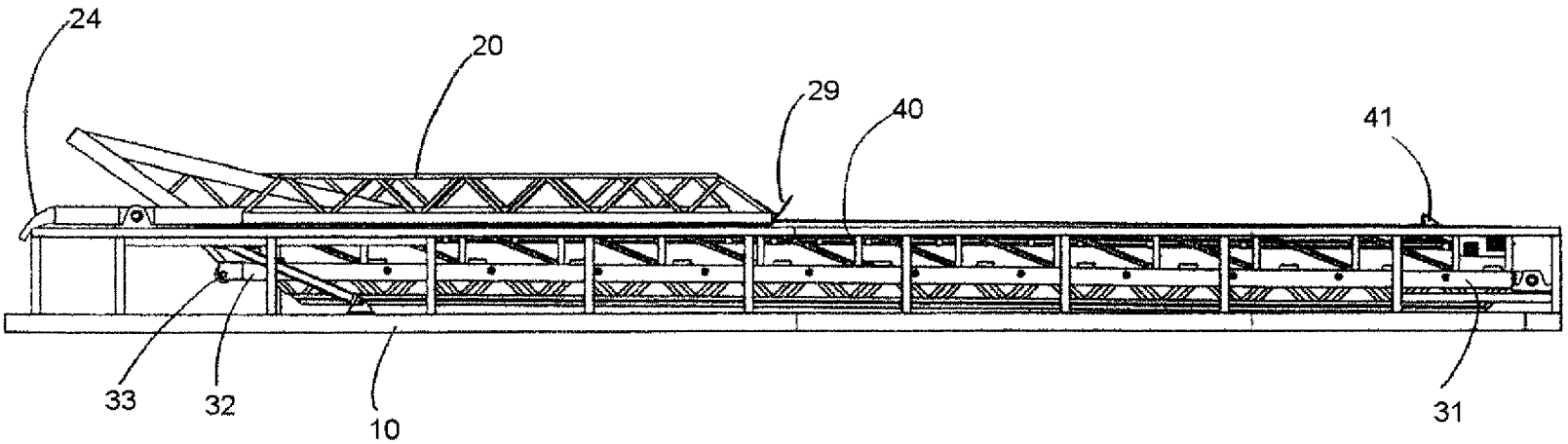
FIG. 3 is a side view of an apparatus for delivering tubulars to an elevated work area, in one embodiment, with carriage in retracted position and carriage support ramp folded for storage.

When in the retracted position, carriage sections 30*a*, 30*b*, and 30*c* are nested and lie against the frame assembly with the leading edge 32 of the carriage extending towards the carriage support ramp 20 as shown in FIG. 2. As shown in FIG. 3, the carriage support ramp 20 may also be folded to rest against the frame assembly 10 for transport and storage.

The attachment of the first end 31 of the extendable carriage to the frame 10 permits pivotal movement (in the vertical plane) of the carriage with respect to the frame, as the carriage is extended. The leading edge 32 of the carriage is therefore driven upwards towards the work area along the carriage support ramp as the carriage is extended. When the tubular 90 is appropriately placed with respect to the work area, it is discharged from the slideway 40 by advancement of a skate 41 along the slideway 40 towards the leading end 32 of the carriage. Alternatively, the tubular may be picked from the slideway by vertical handling equipment.

For break down of a tubing string, the process is reversed, with the tubular 90 placed on the slideway 40 at the work area, with carriage extended as shown in FIG. 1. The carriage is then retracted to withdraw slideway 40 from the work area until the slideway 40 is horizontal, for removal of the tubular 90 from the slideway 40.

Frame

Frame 10 is typically sized for transport upon a trailer, and may bear platform/catwalk surfaces to enable personnel to walk along the frame and climb a ladder or stairs to reach the work area 100. The frame is generally rectangular, and extends lengthwise from a location proximal to the work area to an area distal from the work area. The distal area of the frame is adapted for pivotal attachment of the first end 31 of carriage portion 30, and the proximal area of the frame is adapted for pivotal attachment of carriage support ramp 20.

Pivot anchors 91 may be attached to the frame 10 at appropriate locations to enable attachment of the carriage 30, carriage support ramp 20, hydraulic cylinders, or other components.

The frame may further include, or be attachable to, racks for storing tubulars, other rig equipment, and the like.

Carriage Support Ramp

The carriage support ramp 20 provides a guide surface for directing the leading end 32 of the carriage 30 towards the work area 100. As advancement of the slideway to the work area is driven only by extension of the carriage, carriage support ramp 20 directs the leading end 32 of the carriage 30 upward during extension, which adjusts the pivot angle of the fixed end of the carriage 31 with respect to the frame assembly. A roller and track system minimizes friction between the carriage 30 and ramp 20.

Figure 4:
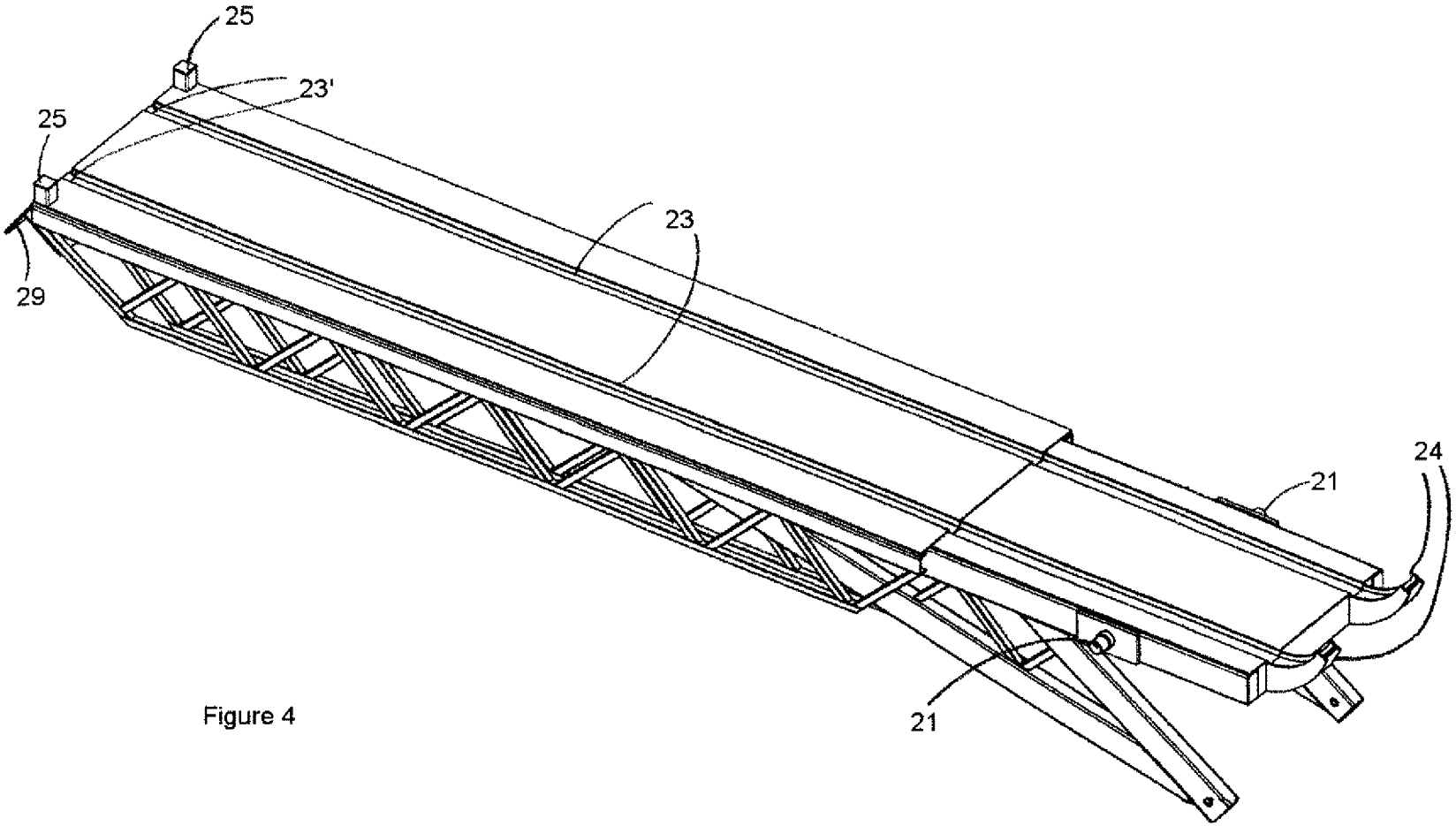
FIG. 4 is a perspective view of an extendable carriage support ramp, in one embodiment.
Figure 6:
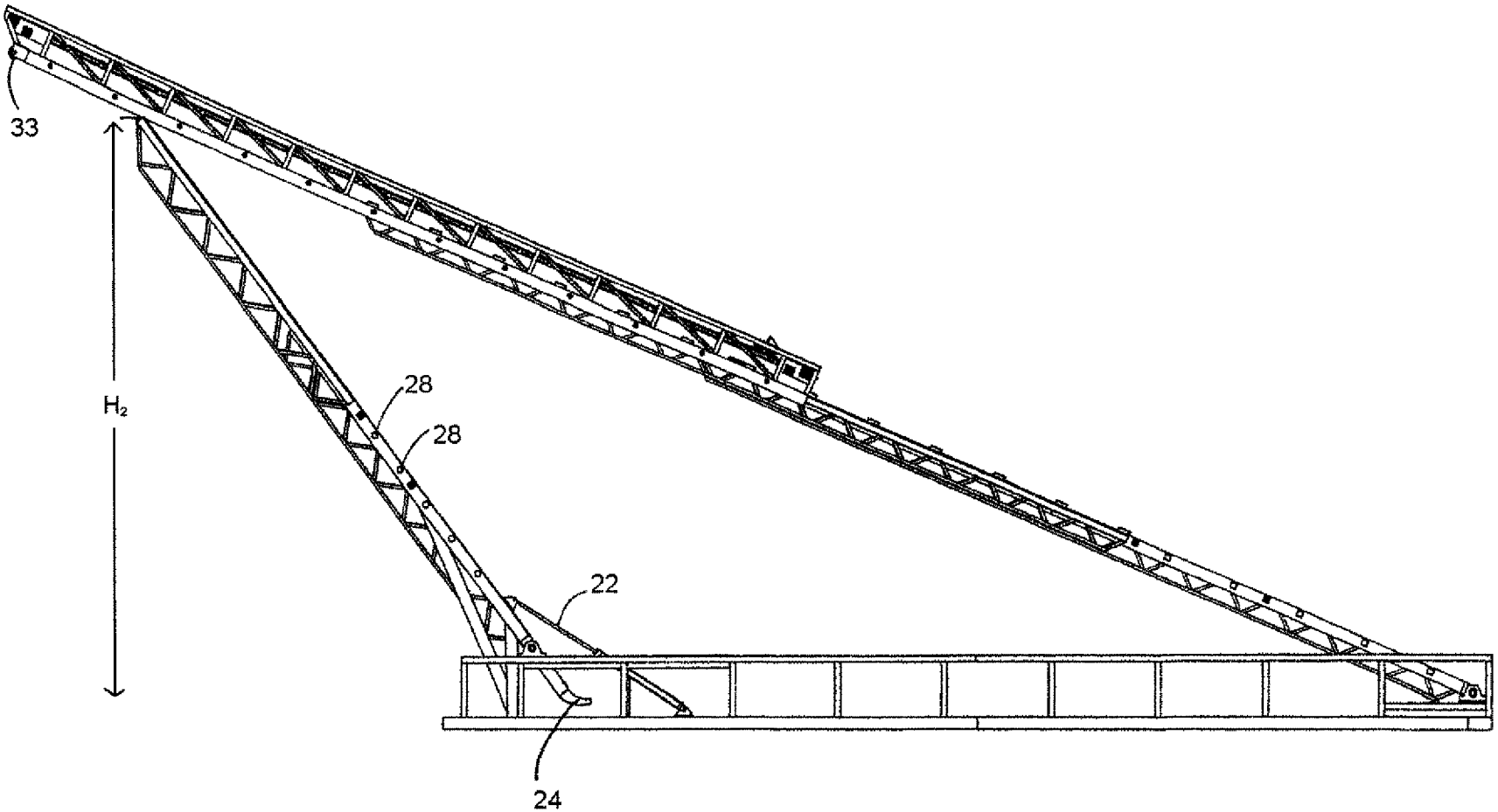
FIG. 6 is a side view of an apparatus for delivering tubulars to an elevated work area, in one embodiment, with carriage and carriage support ramp both fully extended.

With reference to FIG. 4, carriage support ramp 20 is adjustable in length to adapt to various work areas and configurations (for example, $H_1$ in FIG. 1 and $H_2$ in FIG. 6). In FIG. 4, the carriage support ramp is adjusted by sliding a top section over a bottom section, guided by cam rollers. The sliding movement is driven by hydraulic cylinders, such that the relative positions of the support ramp sections may be locked at any desired position. Typically, the carriage support ramp is extendable up to at least 12 feet.

In addition, the position of the top section with respect to the bottom section may be secured by appropriate control of the hydraulic cylinders. Alternatively, locking rods may be inserted through appropriate apertures along the sides of the top and bottom carriage support ramp sections.

Carriage support ramp 20 is pivotally attached to a proximal area of the frame using pins 21 for mating with pivot anchors 91, or by other suitable means. A hydraulic cylinder 22 is attached to the frame 10 and the carriage support ramp 20 for use in folding or extending the ramp 20.

Once the carriage support ramp 20 has been secured to the frame and adjusted to appropriate length, carriage support ramp 20 may be extended to suitable length and attached to any appropriate bracing surface adjacent the work area, for example using bracket 29. Alternatively, the frame and carriage support ramp may be self-supporting, not requiring attachment to a bracing surface. The carriage support ramp should be suitably stabilized to receive and guide the leading end of the carriage, which may exert a significant amount of force against the carriage support ramp during extension towards the work area.

As shown in FIG. 4, the carriage support ramp bears tracks 23 for receiving rollers 33 depending from the leading end of the extendable carriage 30. Curved track guides 24 depend from the lowermost end of the carriage support ramp and are continuous with the tracks 23. Thus, as the leading end of the carriage is extended from the retracted position, rollers 33 at the leading end of the carriage will first abut the curved track guides 24 and be guided to track 23, minimizing jarring of the wheels 33 against the track 23 as the carriage advances.

The track 23 at the uppermost end of the carriage support ramp is tapered 23' to guide the rollers 33 past the end of the carriage support ramp as the carriage continues to extend towards/over the work area. Stops 25 stabilize the carriage during continued extension, preventing lateral movement of the carriage. In the fully extended position, the carriage may rest on the support ramp, stabilized laterally by stops 25.

Extendable Carriage

The extendable carriage is formed from nested, telescopic, or overlapping carriage sections, and may be extended or retracted to advance or withdraw the slideway from the work area.

With reference to the extended carriage 30 shown in FIG. 1, the carriage 30 is fixed to the frame 10 at a first end 31, and a tubular is carried along slideway 40, which is positioned towards the opposite, leading end 32 of the carriage 30. The leading end 32 of the carriage bears rollers 33 for engaging a track 23 along the carriage support ramp 20, to advance the leading end of the carriage upward towards the work area 100 as the carriage 30 is extended in length.

In the embodiment shown in the Figures, the carriage sections are slidably attached, with cam rollers along the edge of each section, and the sections are extended or retracted by hydraulic cylinders on the underside of the carriage. Thus, each hydraulic cylinder drives apart adjacent sections of the carriage, advancing the leading end of the carriage towards the work area. Each hydraulic cylinder is independently controlled to allow locking of the carriage to any desired length.

In retracted position, the sections overlap such that the length of the carriage is less than the length of the frame. As each section is extended, the length of the carriage increases and the slideway 40 advances vertically and horizontally towards the work area 100.

Generally, the extendable carriage will be approximately 25-60 feet in length when fully retracted, and up to 120 feet when fully extended. For most applications, an extended length of 90 feet will be suitable.

The carriage is formed from two, three, or more sliding segments, as appropriate. Some overlap exists between segments to provide stability, even when in the fully extended position. The stationary end is pivotally anchored to the frame assembly so as to permit vertical re-alignment of the carriage during extension, as the leading end travels towards the work area against the support ramp. Such extension to indirectly raise the tubular provides significant stability in handling tubulars. Moreover, as the stationary end of the carriage does not slide or lift, the carriage positions and movements are stable and predictable, posing minimal safety risk to surrounding personnel.

Slideway

The slideway is of appropriate shape and size to receive a particular tubular, or various shapes and sizes of tubulars, and the slideway also includes a mechanism for ejecting the tubular from the slideway. The slideway is carried towards the leading end of the extendable carriage such that advancement of the carriage against and past the carriage support ramp will place the slideway in close proximity to the work area 100.

Generally, for drilling applications, the slideway will accept a tubular of a length from two to twenty inches in diameter, and up to fifty feet long. The tubular is supported within the slideway, which is depressed from the surrounding carriage surface. The slideway and skate 41 maintain the stable position of the tubular during advancement towards the work area.

Figure 5A:
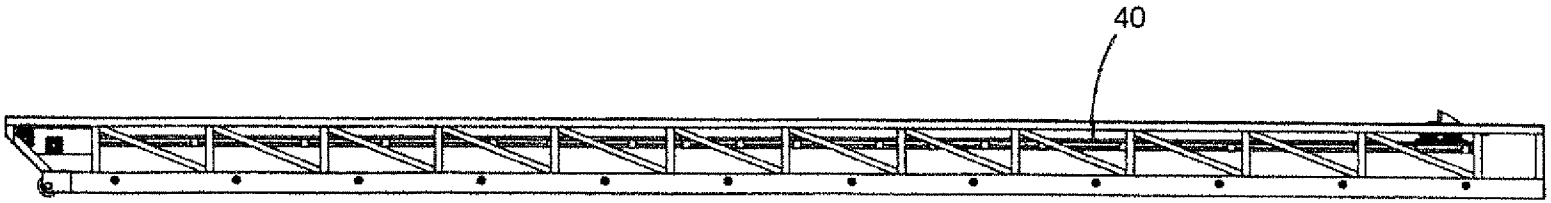
FIG. 5*a* is a side view of a carriage section, in one embodiment, bearing a slideway.
Figure 5B:
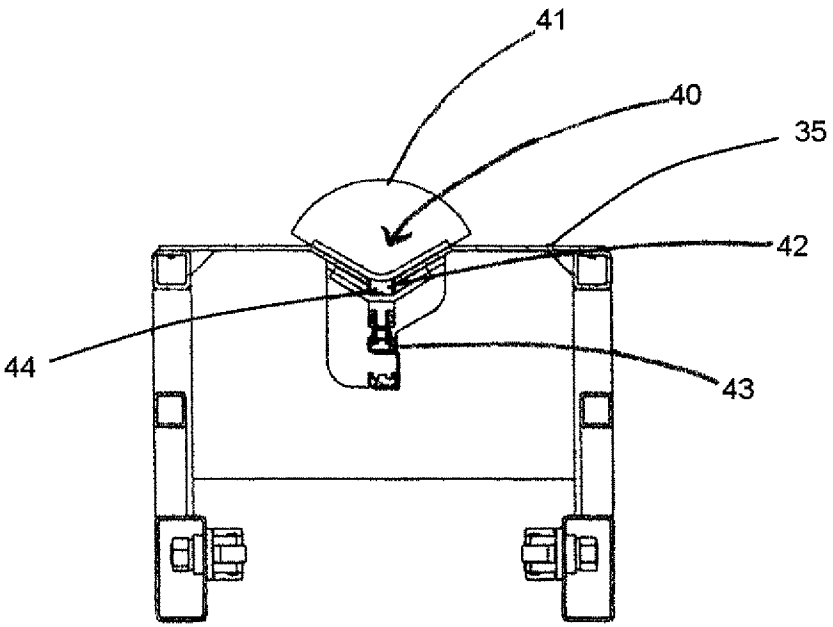
FIG. 5*b* is a cross section of the carriage section and slideway taken along line A-A of FIG. 5*a*.

With respect to FIGS. 5*a* and 5*b*, the slideway 40 is carried by carriage section 30*c*, which is the leading end of the carriage. As shown in FIG. 5*b*, the slideway 40 is formed from the carriage surface 35, which is depressed towards a central longitudinal slot 42. A skate 41, travels longitudinally along the depressed carriage surface of the slideway 40, driven by a sliding skate mechanism 43, situated beneath the depressed carriage surface. A post 44 extends through the slot 42 to associate the skate 40 with the hidden sliding mechanism 43 such that the skate may be advanced along the slot 42 to discharge the tubular from the slideway 40.

Other means of securing the position of various sliding and/or extendable components of the apparatus will be apparent with reference to the present description and drawings. For example, the sliding extension of the carriage and support ramp may be driven manually, using a motor, chain drive, threaded rod and ball screw, or other suitable mechanism. Similarly, the position of the sliding components may be secured using various other means.

Method

In operation, a frame is assembled adjacent a work area, and a carriage support ramp 20 is attached to the frame to extend from the frame towards the work area. Generally, the work area will be elevated from the frame, and the carriage support ramp is adjusted in length and braced against a work platform, forming an obtuse angle with the frame. The extendable carriage is retracted and lies horizontal against the frame to receive a tubular.

Once a tubular is delivered to the slideway with the carriage retracted and horizontal, the carriage may slowly be extended. When the leading end of the carriage extends to meet the carriage support ramp, rollers 33 of the leading end 32 of the carriage will be received by track guides 24 mounted to the carriage support ramp or frame. Further extension of the carriage will force the rollers 33 to advance along the track, up the carriage support ramp 20. The tubular, resting upon slideway 40, is continually advanced towards the work area as the carriage is extended. When the leading end 32 of the carriage 30 reaches the top of the carriage support ramp 20, further extension of the carriage will advance the rollers past the end of the track 23, and the carriage will continue to extend over the top of the carriage support ramp 20. Stops 25 maintain the alignment of the carriage over the carriage support ramp 20.

When the carriage is extended sufficiently to place the tubular within appropriate position over the work area, skate 41 is advanced to partially or fully discharge the tubular from the slideway. Alternatively, the tubular may be picked from the slideway by handling equipment for delivery downhole. The carriage is then fully retracted to horizontal position to receive a further tubular.

For break down of tubing, the process is reversed. That is, the carriage is extended to the work area to receive a tubular from downhole. Once the tubular is placed within the slideway, the carriage is retracted until the rollers 33 of the leading end 32 of the carriage engage the track 23 within the carriage support ramp 20. Further retraction of the carriage results in the rollers 33 sliding down the track 23 until the carriage is in the fully retracted and horizontal position. The tubular is removed, and the carriage is then extended to the work area again to receive a subsequent tubular from downhole.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. An apparatus for use in delivering tubulars to a work area, the apparatus comprising:

a base frame assembly for placement adjacent a raised work area;

an adjustable support ramp extending from the base frame assembly towards the work area, the support ramp comprising a track;

an extendable carriage member comprising: a stationary end pivotally anchored to the frame in alignment with the support ramp and work area; an opposing leading end advanceable against the support ramp upon extension of the carriage member, and having a slideway for carrying a tubular, the slideway positioned at the leading end of the carriage member, and the slideway having a skate assembly configured to push the tubular along the slideway; and the extendable carriage member comprising a first carriage segment extendable from a second carriage segment and a hydraulic cylinder attached to a first carriage segment and a second carriage segment, the hydraulic cylinder for driving the first carriage segment in extension from the second carriage segment.

2. The apparatus as in claim 1, wherein the leading end of the carriage member comprises a roller for guiding the leading edge against the support ramp.

3. The apparatus as in claim 1, wherein the support ramp further comprises guide stops for preventing lateral movement of the carriage as it is advanced against the ramp.

4. The apparatus as in claim 1, further comprising a locking mechanism for locking the position of the first carriage segment with respect to the second carriage segment.

5. The apparatus as in claim 1, wherein the carriage is of sufficient length to position the slideway over the work area when the carriage is fully extended.

6. The apparatus as in claim 1, wherein the support ramp is adjustable in length by sliding extension of a first ramp segment against a second ramp segment.

7. The apparatus as in claim 6, further comprising a hydraulic cylinder operatively attached to the first and second ramp segments, the hydraulic cylinder for driving the first ramp segment in sliding movement with respect to the second ramp segment.

8. The apparatus as in claim 1, wherein the base frame assembly further comprises a catwalk surface.

9. The apparatus as in claim 1, further comprising a storage rack for supplying and receiving tubulars to and from the slideway.

10. The apparatus as in claim 1, wherein the skate assembly comprises:

a sliding skate mechanism situated beneath a depressed surface within the slideway;

a post extending through a slot within the slideway; and a skate coupled to the post and capable of sliding along the slot when the sliding skate mechanism is actuated.

11. A method for delivering tubulars to a raised work area, the method comprising the steps of:

receiving a tubular on a slideway for receiving and discharging tubulars, the slideway disposed on an extendable carriage, the extendable carriage pivotally fixed to a base frame assembly adjacent a raised work area;

extending the carriage in length to direct a leading end of the carriage toward the work area;

guiding the leading edge of the extendable carriage toward the work area as the carriage is extended on an adjustable support ramp;

advancing the tubular along the slideway toward the work area by movement of a skate assembly along the slideway; and discharging the tubular from the slideway.

12. The method as in claim 11, further comprising the step of bracing the support ramp against a support surface adjacent the work area.

13. The method as in claim 12, further comprising the step of adjusting the length of the support ramp to extend from the base frame assembly to the work area.

* * * * *